US011877668B2

(12) United States Patent
Ishida

(10) Patent No.: US 11,877,668 B2
(45) Date of Patent: Jan. 23, 2024

(54) NECK PILLOW

(71) Applicant: MOGU CO., LTD., Miki (JP)

(72) Inventor: Yoshinobu Ishida, Miki (JP)

(73) Assignee: MOGU CO., LTD., Miki (JP)

( * ) Notice: Subject to any disclaimer, the term of this patent is extended or adjusted under 35 U.S.C. 154(b) by 218 days.

(21) Appl. No.: 17/638,612

(22) PCT Filed: Mar. 18, 2020

(86) PCT No.: PCT/JP2020/012083

§ 371 (c)(1),
(2) Date: Feb. 25, 2022

(87) PCT Pub. No.: WO2021/038937

PCT Pub. Date: Mar. 4, 2021

(65) Prior Publication Data

US 2022/0338636 A1 Oct. 27, 2022

(30) Foreign Application Priority Data

Aug. 30, 2019 (JP) ..... 2019-158728

(51) Int. Cl.
*A47C 7/38* (2006.01)
*A47G 9/10* (2006.01)

(52) U.S. Cl.
CPC ..... *A47C 7/383* (2013.01); *A47G 9/1081* (2013.01)

(58) Field of Classification Search
None
See application file for complete search history.

(56) References Cited

U.S. PATENT DOCUMENTS

| | | | | |
|---|---|---|---|---|
| 10,154,697 | B2 | 12/2018 | Kasahara | |
| 2003/0159217 | A1 | 8/2003 | Clemons | |
| 2004/0128744 | A1* | 7/2004 | Cleveland | A41D 13/0512 2/425 |
| 2010/0218299 | A1* | 9/2010 | Damir | A41B 13/06 2/69.5 |

(Continued)

FOREIGN PATENT DOCUMENTS

| | | | | |
|---|---|---|---|---|
| DE | 20209966 | U1 * | 1/2003 | A61F 13/128 |
| EP | 2500001 | A2 * | 9/2012 | A61F 5/055 |

(Continued)

OTHER PUBLICATIONS

European Patent Office, Extended European Search Report issued in corresponding Application No. 20858612.3, dated Aug. 11, 2023.

(Continued)

*Primary Examiner* — David E Allred
(74) *Attorney, Agent, or Firm* — Stites & Harbison, PLLC; Jeffrey A. Haeberlin

(57) ABSTRACT

A neck pillow comprising a cylindrical body that can encircle a neck of a human body, wherein the neck pillow is wearable around and detachable from the neck, wherein the cylindrical body has hardness for stably supporting the neck of the wearer and is provided with a fastener that is openable and closable on a front side of a wearer, and wherein degree of opening of the fastener can be adjusted by a millimeter unit from an upper edge of the cylindrical body in accordance with a height of the lower jaw of the wearer.

8 Claims, 7 Drawing Sheets

(56) References Cited

U.S. PATENT DOCUMENTS

| | | | | |
|---|---|---|---|---|
| 2013/0312192 | A1* | 11/2013 | Lee | A47C 7/425 5/639 |
| 2014/0331397 | A1 | 11/2014 | Kasahara | |
| 2016/0007777 | A1 | 1/2016 | Gang et al. | |
| 2017/0127858 | A1* | 5/2017 | Teh | A47G 9/1045 |
| 2019/0313715 | A1* | 10/2019 | Douglas | A41D 13/0512 |
| 2021/0007420 | A1* | 1/2021 | Gangan | A41B 13/06 |

FOREIGN PATENT DOCUMENTS

| | | | |
|---|---|---|---|
| JP | 3053720 | U | 11/1998 |
| JP | 3074457 | U | 1/2001 |
| JP | 2014-018624 | A | 2/2014 |
| JP | 1506304 | S | 9/2014 |
| SE | 537756 | C2 | 10/2015 |
| WO | 2013/111295 | A1 | 8/2013 |

OTHER PUBLICATIONS

Japan Patent Office, International Search Report issued in corresponding Application No. PCT/JP2020/012083, dated Apr. 21, 2020.

* cited by examiner

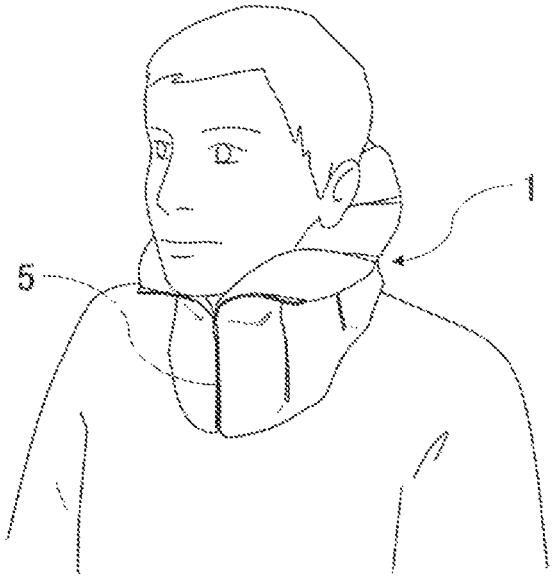
*FIG. 9*
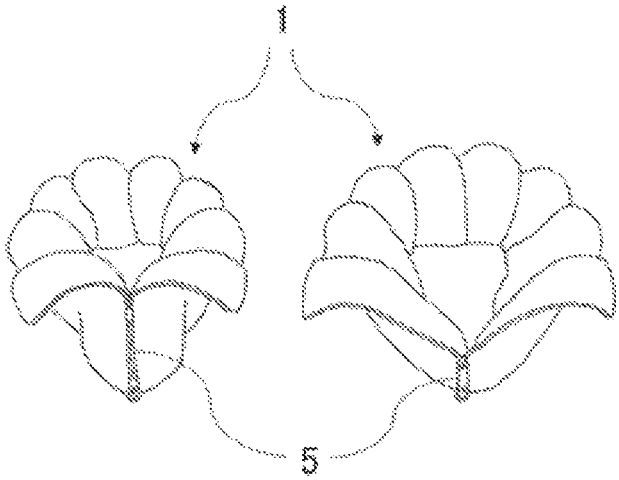
*FIG. 10(a)* *FIG. 10(b)*
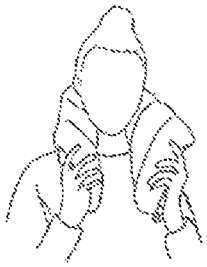
*FIG. 11(a)*
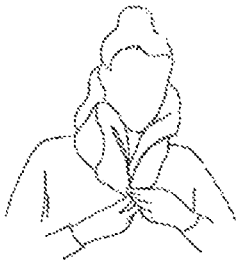
*FIG. 11(b)*
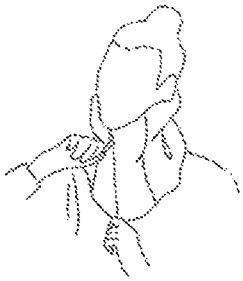
*FIG. 11(c)*

NECK PILLOW

TECHNICAL FIELD

The present invention relates to a neck pillow. More specifically, the present invention relates to the neck pillow that can be worn around the neck when traveling by an automobile, a train, an airplane, or the like, or when resting, in order to support a wearer's head and prevent the neck from collapsing.

BACKGROUND ART

For the purpose of preventing the neck from collapsing when traveling by an automobile, a train, an airplane, or the like, or when resting, cushion bodies with a U-shaped outline to be worn around the neck have been commercially available under the name of neck pillows (see, for example, Patent Document 1). However, with such neck pillows, the occurrence of neck pain could not be sufficiently suppressed because the neck was not sufficiently held.

Therefore, the applicant has proposed a neck pillow with a shape that better fits a circumferential outline of the neck (see, for example, Patent Document 2). Such a neck pillow has a U-shaped outline, a pentagonal shape in an area along the neck, and a greater height than the conventional neck pillows, making the neck pillow more effective in preventing neck collapse.

PRIOR ART DOCUMENTS

Patent Document

Patent Document 1: Japanese Registered Utility Model No. 3053720

Patent Document 2: Japanese design registration No. 1506304

SUMMARY OF THE INVENTION

Problems to be Solved by the Invention

The above neck pillows can prevent the occurrence of neck pain caused by neck collapse when traveling by a car, a train, an airplane, or the like, or when resting.

In the meanwhile, it has been desired to provide a neck pillow that fits shapes of wearers' necks and lower jaws, even if thicknesses and lengths of the wearers' necks and shapes of the lower jaws may vary, and thus further improves effectiveness of preventing neck collapse.

Solutions to the Problems

The present invention provides a neck pillow comprising a cylindrical body that can encircle a neck of a human body, wherein the neck pillow is wearable around and detachable from the neck, wherein the cylindrical body has hardness for stably supporting the neck of a wearer and is provided with a fastener that is openable and closable on a front side of the wearer, and wherein degree of opening of the fastener can be adjusted by a millimeter unit from an upper edge of the cylindrical body in accordance with a height of the lower jaw of the wearer.

Effects of the Invention

The neck pillow of the present invention is adjustable to degree of neck retention according to wearers' preferences even if the wearers have different neck lengths and/or thicknesses, and/or different shapes of the lower jaws.

Common neck pillows have a U-shaped outline, which is open on the lower jaw side, and thus have not been adjustable to wearers' preferences in degree of head retention. In addition, because being open on the lower jaw side, the neck pillows lack an ability to retain the front side of the head, and thus have been difficult to restrain the occurrence of neck pain when the head fell forward.

On the other hand, the present invention has structures such as the above-mentioned cylindrical body and fastener, which are not present in the common neck pillows, and thus is capable of restraining the occurrence of neck pain even more efficiently.

BRIEF DESCRIPTION OF THE DRAWINGS

FIG. 9 shows a reference diagram of an example of how the neck pillow in accordance with Embodiment 1 is used.

FIGS. 10(*a*) and 10(*b*) shows reference diagrams of examples of how the neck pillow in accordance with Embodiment 1 is used.

FIGS. 11(*a*) to 11(*c*) shows diagrams of how to use the neck pillow in accordance with Embodiment 1.

Figure 1:
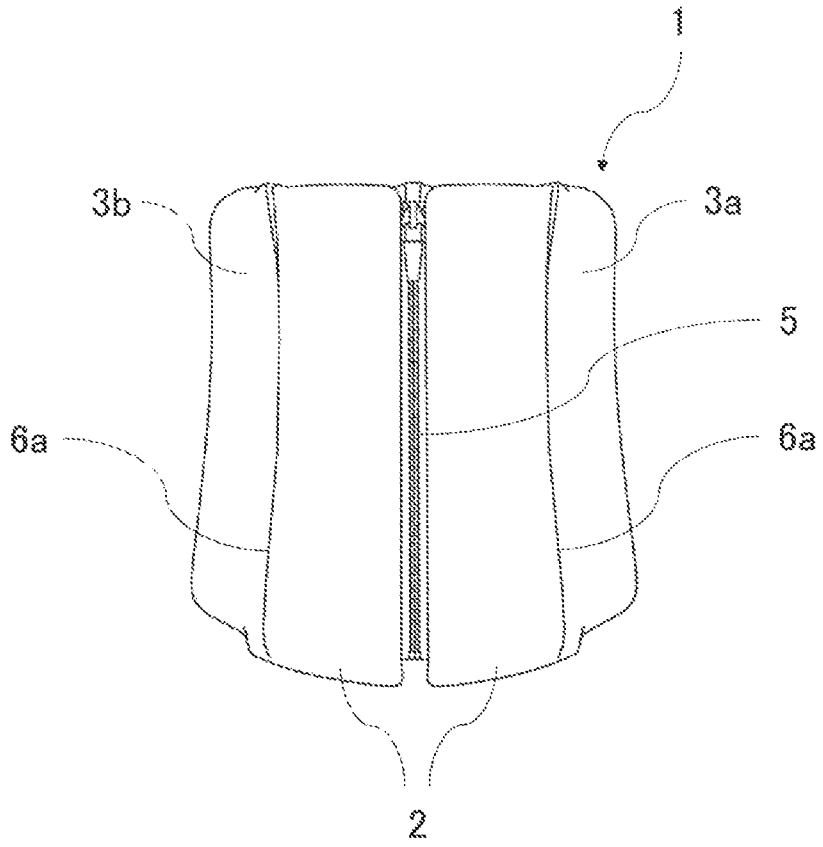
FIG. 1 shows a front view of a neck pillow in accordance with Embodiment 1 (which corresponds to the front side of the face).

EMBODIMENTS OF THE INVENTION (1) A neck pillow 1 of the present invention comprises a cylindrical body that can be detachably worn around a neck of a human body to encircle the neck.

In the present invention, "neck" means a region from at least the third cervical vertebra (or a lower end of a lower jaw) as an upper end to the seventh cervical vertebra as a lower end.

The "cylindrical body" has hardness for stably supporting the neck of a wearer.

The hardness for supporting the neck means firmness that can retain the weight of a head to prevent the neck from falling back and forth, left and right, due to the weight of the head, which can cause neck pain.

The neck pillow 1 of the present invention can realize sufficient hardness for supporting the neck by enclosing filling material in the cylindrical body. Also, the neck pillow 1 of the present invention can further enhance the retention to the neck by folding about one-third (⅓) from an upper edge of the neck pillow outward.

Components for forming the neck pillow 1 of the present invention are not particularly limited. For example, the neck pillow 1 may have at least the cylindrical body and the filling material filled in the cylindrical body.

By having a fastener that is openable and closable on the front side of wearers, the neck pillow 1 becomes adjustable to degree of neck retention according to the wearers' preferences, even if the wearers have different neck lengths and/or thicknesses, and/or different shapes of the lower jaws. Such adjustability means that a single neck pillow 1 is applicable to wearers with different neck shapes (for example, wearers of all ages from children to adults).

Material for the cylindrical body is not particularly limited and may be made of any known cloth to be used as material for the neck pillow 1. The cloth may be made of woven or non-woven fabric made from cotton, linen, silk, wool, synthetic fiber, or the like, or may be made of blended fabric. The cloth may have functionalities. As examples of the functionalities, there may be mentioned moisture-absorbing and heat-generating property, water resistance, water repellency, moisture-absorbing and quick-drying property, and odor resistance. The cloth may have one or more functionalities.

The cloth may or may not have stretchability. It is preferable that the cloth should provide the stretchability to the cylindrical body. The stretchable cylindrical body allows the filling material to move from a compressed site to other sites; and a volume of the pushed filling material may be permissible in bag bodies at the other sites since the bag bodies stretch and deform, thereby allowing a permissible range of movement of the filling material to further increase and, as a result, providing the neck pillow 1 that is capable of better following the contours of the neck.

A thickness of the cloth is not particularly limited, and the cloth may be thin or thick. The thin cloth can provide the neck pillow with an improved texture. The thick cloth can provide an increased neck support effect; therefore, even if neck pain symptoms have already developed, a neck retaining effect, like a corset, can be expected. The thickness of the cloth may vary at the front, sides, and back of the neck.

Also, the thickness of the cloth at the sides that are to contact the neck may be different from the thickness of the cloth at the outer side of the neck.

It is desirable that the cylindrical body should have a stretchability of 10 to 300%. The stretchability may be, for example, 10%, 30%, 50%, 100%, 150%, 200%, 250%, or 300%. An example of the stretchable material is material with elasticity, such as spandex (polyurethane elastic yarn).

The stretchability may vary at the front, sides, and back of the neck; and furthermore, the stretchability at the sides that are to be in contact with the neck may be different from the stretchability at the outer side of the neck. Non-stretchable cloth may be used in parts.

The cylindrical body is desirably almost tubular in shape; however, the shape of the cylindrical body is not particularly limited as long as the cylindrical body can be filled with a sufficient amount of the filling material in such a way that the cylindrical body can stably support the neck. The cylindrical body may be parallel, perpendicular, or oblique to a longitudinal direction of the neck. The cylindrical body may have a shape that spreads from the head side to the shoulder side to fit shapes of neck muscles and may intersect with an adjacent cylindrical body.

The filling material is not particularly limited, and any known filling material for the neck pillow 1 can be used. As examples of the filling material, there may be mentioned foam beads, urethane foam, cotton, non-woven fabric, resin pipes, a three-dimensional composite of resin fiber, gel, rubber, sand, and air. The filling material may have a cold retention function or a heat retention function. For example, if air is used as the filling material, the neck pillow filled with the air fits shapes of the neck and the lower jaw of a wearer, thereby better preventing neck collapse. If the air is used, a manual or electric pump may be installed to achieve a better fit desired by the wearer.

Of the above filling materials, the foam beads are preferable. Among the foam beads, polystyrene foam beads are desirable that have a flow-accelerating agent attached to a surface and an average particle diameter of 0.4 to 1.4 mm. Since the polystyrene foam beads have high flowability, beads thereof can move along an outline of the neck when the neck pillow 1 is worn, thus providing the neck pillow 1 that better fits the outline of the neck. The average particle diameter may be, for example, 0.4 mm, 0.6 mm, 0.8 mm, 1 mm, 1.2 mm, or 1.4 mm.

The foam beads have high thermal insulation and thus have advantages in preventing a wearer's body temperature from dropping due to sleep and enabling the wearer to have better sleep even when the wearer sleeps with the neck pillow 1 on.

By filling the bag bodies with the filling material having a volume equal to or larger than an internal volume of the bag bodies, the filling material can impart hardness to the neck pillow 1 that can support the neck. It is desirable that the volume of the filling material to be filled into the bag bodies should be 1.1 to 3.5 times the internal volume of the bag bodies. The volume of the filling material may be, for example, 1.1 times, 1.5 times, 2.0 times, 3.0 times, or 3.5 times the internal volume of the bag bodies.

A magnet may be optionally placed at any location at a front part, side parts, and a back part of the neck pillow 1. Magnetic particles may be enclosed together with the filling material in the cylindrical body. A magnetic action is also expected to take stiffness out of the neck and/or the shoulders.

The neck pillow 1 may be equipped with any of the following mechanisms at any position of the front part, the side parts, and the back part: a mechanism that mechanically massages the neck by using a rubbing ball installed; a mechanism that generates a low frequency; a mechanism that generates a weak electric current (EMS: Electrical Muscle Stimulation); and a mechanism that generates low vibrations. By having any of these mechanisms, the neck pillow 1 that is worn is capable of supporting the neck and also relieving stiffness in the neck and/or the shoulders.

The neck pillow 1 may be optionally provided with a pocket at any position of the front part, the side parts, and the back part of the neck pillow to place a warmer or cooling material therein. The warmer or the cooling material can be used to adjust a temperature when the neck pillow 1 is worn. Instead of the warmer or the cooling material, a smartphone, an MP3 player, or the like may be placed in this pocket. By placing the smartphone in the pocket, an alarm function of the smartphone can be used, allowing a wearer to wake up at a desired time. The temperature adjustment may also be achieved by providing the neck pillow 1 with a heat retention function inside that can electrically control a temperature, such as a heater. Furthermore, by optionally providing the neck pillow 1 with a fan at any position of the neck pillow, air can be circulated, and a temperature may be adjusted.

The neck pillow 1 may be optionally provided with reinforcing material such as a bone or a wire at any place of the front part, the side parts, and the back part. With the reinforcing material, the neck pillow can be provided that can better support the head of a wearer and can better prevent the neck from collapsing. A shape of the bone may be a rectangular plate or may be an X-shaped plate. According to the degree of support for the wearer's head, the following may be properly determined: material, strength, length, width, and thickness of the bone; material, strength, length, diameter, and the like of the wire; and the number of bones and wires. The length of the wire may be adjusted by a winding mechanism with a dial.

Functional material may be impregnated with or adhered to any optional place of the neck pillow 1. Examples of functionalities produced by the functional material include enhancement of blood flow and moisture retention. The functional material may be dissolvable or dispersible in water or an organic solvent and is not particularly limited as long as the functional material has the desired function. As examples of the functional material, there may be mentioned inorganic materials such as metals, such as titanium, gold, silver, copper, and their oxides, and nitrides. Examples of the functional material may also include organic materials such as moisturizing agents, such as hyaluronic acid, collagen, and ceramide, and fragrances.

The neck pillow 1 may have a hood and/or an eye mask attached to the upper edge thereof. By wearing the hood and/or covering the eyes with the eye mask, a resting effect can be further enhanced. Furthermore, the neck pillow 1 may be integrated with a face mask and/or an ear mask. With the face mask and/or the ear mask, the neck pillow can be expected to have a moisturizing effect around the mouth, the nose, and/or the ears, and also a preventive effect against infectious diseases.

The neck pillow may be provided with a strap for attaching earplugs or earphones thereto and a pouch for storing the earplugs or the earphones therein to prevent loss of the earplugs or the earphones.

The neck pillow 1 may be integrated with an outerwear. The neck pillow 1 integrated with the outerwear may or may not be detachable from the outerwear. To make the neck pillow detachable, buttons, snap buttons, a fastener, or the like may be used.

(2) A type of the fastener is not particularly limited as long as the fastener is openable and closable, and degree of opening of the fastener from an upper edge of the cylindrical body can be adjusted by a millimeter unit in accordance with a height of a wearer's lower jaw. Examples of the fastener include a point fastener, a zip fastener, and a hook-and-loop fastener. Of these fasteners, the zip fastener and the hook-and-loop fastener are preferable, as these fasteners allow for easier adjustment of the degree of opening by a millimeter unit; and the zip fastener is more preferable. The zip fastener may have a locking mechanism. By having the locking mechanism, the degree of opening can be more easily adjusted by a millimeter unit.

A position of the fastener is not particularly limited as long as the fastener can be opened and closed, and the degree of opening can be adjusted by a millimeter unit from the upper edge of the cylindrical body according to the height of the wearer's lower jaw.

The fastener may be placed on the side that is to be in contact with the neck, on the outer side of the neck, or at an intermediate position between the side to be in contact with the neck and the outer side of the neck, in a longitudinal direction of the cylindrical body.

"Adjusting the degree of opening by a millimeter unit" means that the opening can be adjusted, for example, every 0.1 mm or can be adjusted every 10 mm. The degree of opening can be adjusted for each numerical value from 0.1 to 10 mm. For example, the degree of opening can be adjusted every 0.1 mm, 0.5 mm, 1 mm, 5 mm, 7 mm, or 10 mm.

(3) The fastener may have a length of 10 to 25 cm.

By having the length within this range, it becomes easy for the fastener to appropriately adjust the degree of opening to the height of the wearer's lower jaw. The length of the fastener can be, for example, 10 cm, 15 cm, 20 cm, or 25 cm.

(4) The fastener may be openable and closable from at least one of a top and a bottom thereof.

The fastener being openable and closable from the at least one of the top and the bottom enables wearers to adjust degree of neck retention to suit the wearers' preferences even if the wearers have different neck lengths or thicknesses, different shapes of the lower jaws, and so forth.

The fastener may be able to open the cylindrical body completely separable to the left and right or may be able to open the cylindrical body halfway to the left and right. When the fastener is opened halfway to the left and right, the neck pillow 1 can be worn around the neck by passing the head through the neck pillow.

(5) The cylindrical body may have a shape in which the front side of the wearer extends downward longer than the back side.

The cylindrical body having the shape in which the front side of the wearer extends downward longer than the back side is capable of further preventing the neck from falling backward and forward. The front side refers to the lower jaw side of the wearer, and the back side refers to the occipital side of the wearer.

(6) The cylindrical body may have a shape in which the front side of the wearer extends 1 to 15 cm downward longer than the back side. For example, the front side may extend 1 cm, 5 cm, 7 cm, 10 cm, or 15 cm downward longer than the back side.

The cylindrical body is preferably shaped with the front side extending 1 to 15 cm downward longer than the back side, and more preferably with the front side extending 7 to 15 cm downward longer than the back side.

The neck pillow 1 of the present invention has the cylindrical body that can encircle an entire circumference of the neck and is thereby capable of preventing the neck from falling back and forth, left and right.

(7) The cylindrical body may have at least a length such that the upper edge is positioned near the lower jaw of the wearer, and a lower edge is positioned at an upper part of the sternum of the wearer, on the front side of the wearer.

In this way, the cylindrical body can realize a length that is long enough to limit a range of motion of the neck in order to prevent the neck from collapsing back and forth, left and right, due to a weight of the head, which can cause neck pain, so that the neck can be stably supported from the sternum area, thereby further inhibiting the neck from collapsing backward and forward.

The length of the cylindrical body mentioned here is a length from the upper edge to the lower edge.

The length of the cylindrical body on the front side of the wearer is not particularly limited as long as the cylindrical body is long enough to stably support the neck of the wearer; however, it is preferable that the cylindrical body should be from 3 to 40 cm in length, and more preferably from 10 to 25 cm. The length of the cylindrical body can be, for example, 3 cm, 10 cm, 15 cm, 20 cm, 25 cm, 30 cm, 35 cm, or 40 cm.

(8) The cylindrical body may have a shape in which an inner surface surrounding the neck is wider on the front side toward the lower side of the cylindrical body.

In this way, the fastener can be opened and closed from the upper edge and/or the lower edge of the cylindrical body, and thus becomes adjustable to degree of neck retention to suit the wearer's preferences.

(9) With respect to a length in a front-back direction of the inner surface surrounding the neck, the cylindrical body may have a shape in which the lower edge on the front side extends 0.1 to 10 cm longer than the upper edge.

In this way, the fastener can be opened and closed from the upper edge and the lower edge of the cylindrical body, and thus becomes adjustable to the degree of neck retention to suit the preferences of the wearers with different neck thicknesses, who range from children to adults.

The cylindrical body may extend, for example, 0.1 cm, 0.5 cm, 1 cm, 5 cm, 7 cm, or 10 cm longer at the lower edge than the upper edge on the front side.

(10) The cylindrical body may comprise four to sixteen bag bodies configured to enclose filling material therein, at least in an upper part of the cylindrical body.

In this way, the cylindrical body can be partitioned with the plurality of bag bodies; and excessive movement of the filling material can be limited even when pressure is applied thereto.

As a result, the cylindrical body can be formed to further follow the contours of the neck.

The bag bodies that form the cylindrical body may not necessarily be uniform, and a combination of the bag bodies with multiple shapes may form the cylindrical body.

As for the bag bodies forming the cylindrical body, four to sixteen bag bodies are preferable; and six to twelve bag bodies are more preferable.

(11) The neck pillow 1 of the present invention can be used for recovery of an athlete.

For example, by wearing the neck pillow after training, a wearer can recover from inflammation, fatigue, or the like of fatigued muscles around the neck, such as trapezius muscles, (in quest of early recovery) since the weight of the head can be supported by the neck pillow.

Powder beads are expected to have a high heat insulating effect; therefore, the neck pillow worn through cooling material after a workout can help the muscles around the neck recover quickly from inflammation. The neck pillow 1 may be optionally provided with a pocket for storing the cooling material, which is attached to the inner side of the neck pillow at any position that comes in contact with the neck. This position may be on the back side, which corresponds to an area around the trapezius muscles where are easily fatigued by training.

Furthermore, when an athlete wears the neck pillow 1 when traveling to a destination, the neck pillow allows the athlete to rest without being bothered by the weight of the head, thus allowing the athlete to recover while traveling. Also, since the weight of the head does not bother the athlete, the athlete can enhance concentration without being distracted.

(12) The neck pillow 1 of the present invention can be used to prevent stiff shoulders in daily life (for example, at home or at work). For example, the neck pillow can prevent stiff shoulders particularly effectively when the weight of the neck is supported by the muscles around the neck, such as when operating a PC (personal computer) or a smartphone, playing a game, or reading.

The present invention will be described in more detail with reference to Embodiments below; however, the present invention is not limited to these Embodiments.

Embodiment 1

Figure 2:
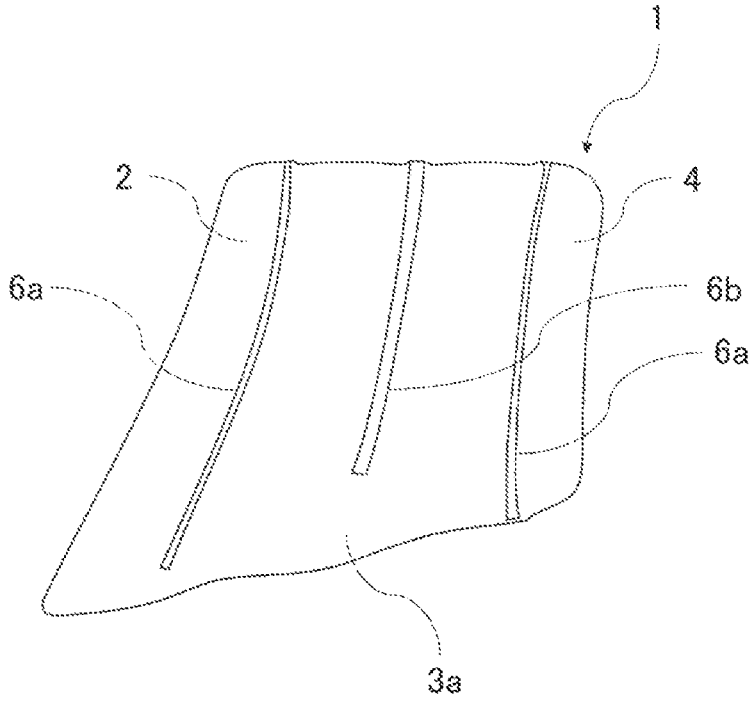
FIG. 2 shows a right side view of the neck pillow in accordance with Embodiment 1 (which corresponds to the left side of the face).
Figure 3:
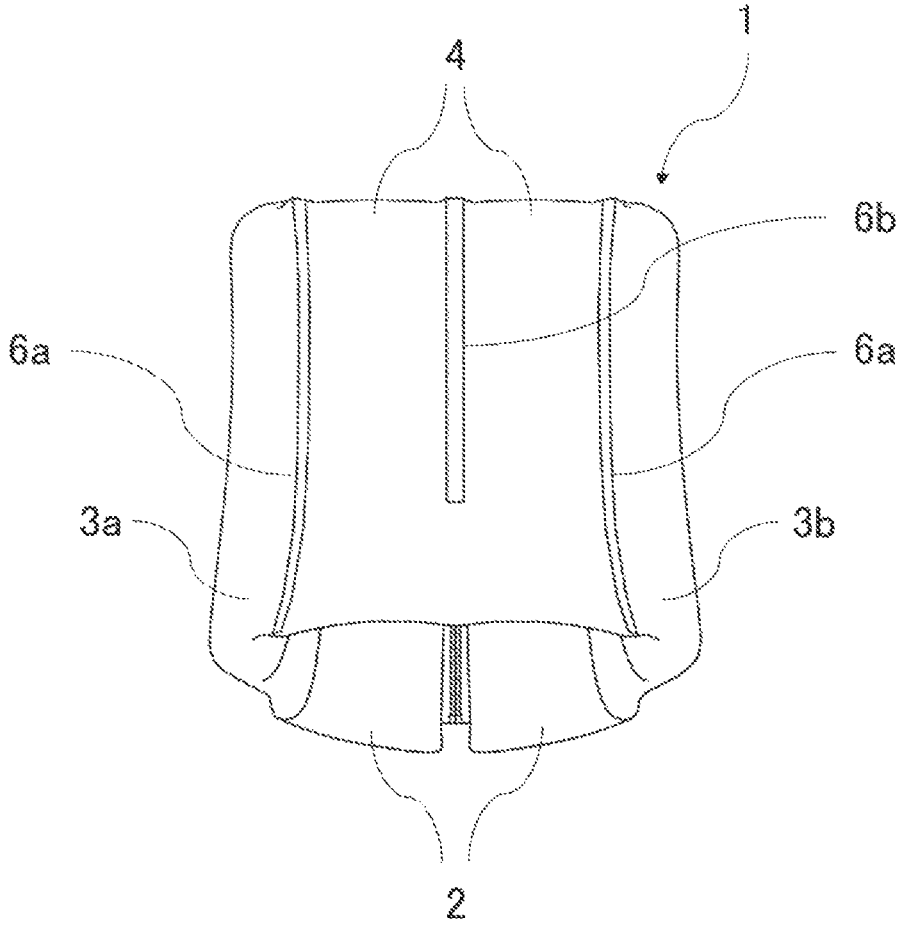
FIG. 3 shows a back view of the neck pillow in accordance with Embodiment 1 (which corresponds to the occipital side).
Figure 4:
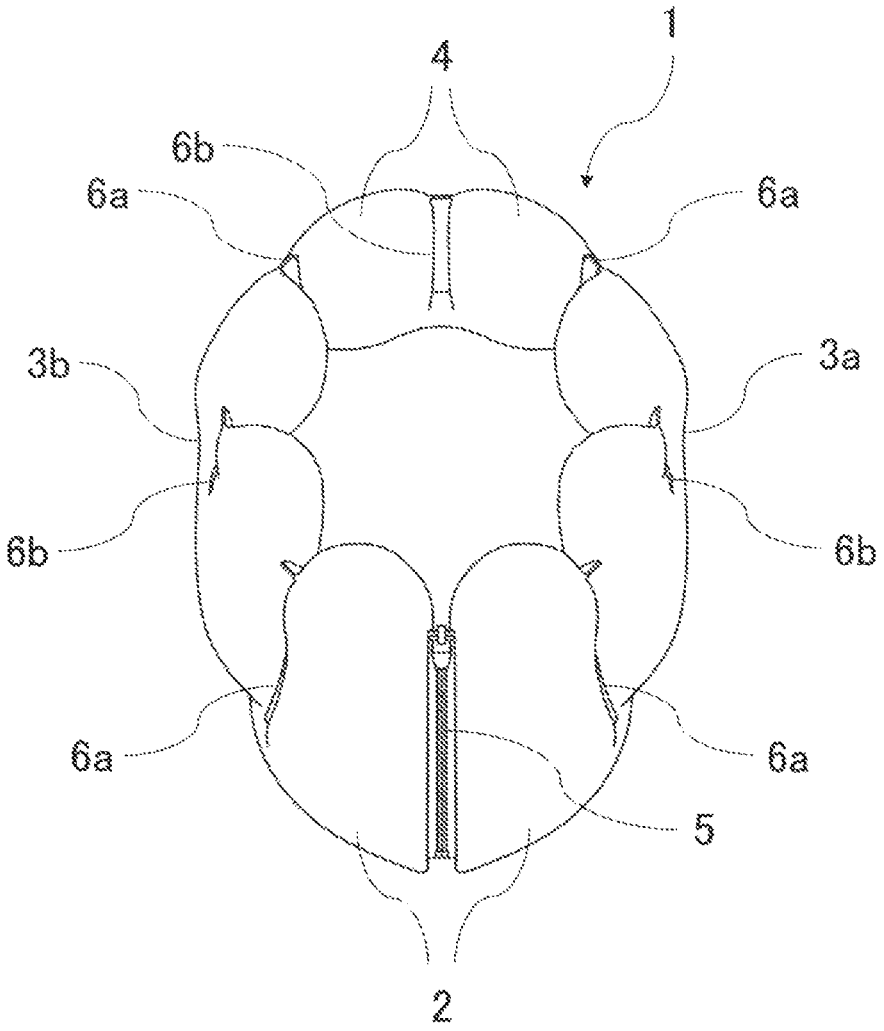
FIG. 4 shows a plan view of the neck pillow in accordance with Embodiment 1 (which corresponds to the parietal side).
Figure 5:
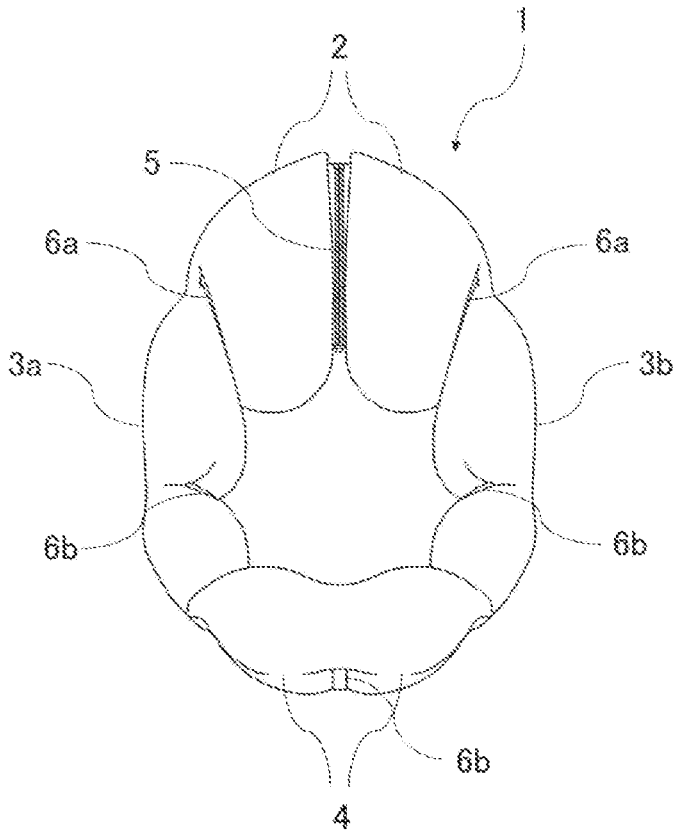
FIG. 5 shows a bottom view of the neck pillow in accordance with Embodiment 1.
Figure 6:
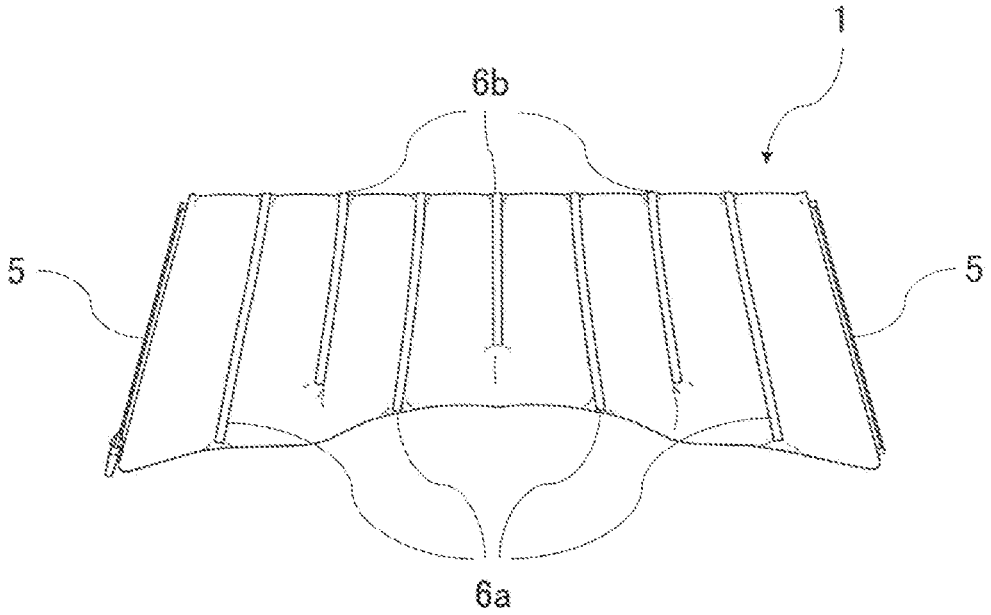
FIG. 6 shows an expanded view of the neck pillow in accordance with Embodiment 1.

FIG. 1 to FIG. 6 show an example of a neck pillow 1 in accordance with Embodiment 1. FIG. 1 shows a front view (corresponding to the frond side of the face); FIG. 2 shows a right side view (corresponding to the left side of the face; a left side view is omitted because it is symmetrical to the right side view); FIG. 3 shows a back view (corresponding to the occipital side); FIG. 4 shows a plan view (corresponding to the parietal side of the head); FIG. 5 shows a bottom view; and FIG. 6 shows a development view.

Figure 7:
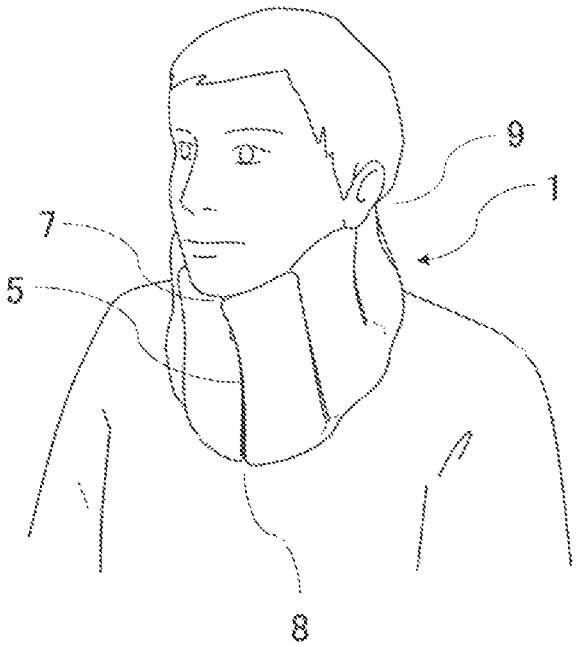
FIG. 7 shows a reference diagram of an example of how the neck pillow in accordance with Embodiment 1 is used.

FIG. 7 shows a reference diagram showing an example of how the neck pillow 1 is used.

The neck pillow 1 in accordance with Embodiment 1 comprises stretchable bag bodies and filling material (for example, foam beads) filled in the bag bodies. The neck pillow 1 in accordance with Embodiment 1 has hardness to support the head; and this hardness can be achieved by filling the bag bodies with the filling material in a volume greater than an internal volume of the bag bodies (for example, filling the bag bodies with the filling material in a volume about 2.5 times the internal volume of the bag bodies).

The neck pillow 1 has a cylindrical body that can wrap around an entire circumference of the neck. By having the cylindrical body, the neck pillow is capable of preventing the neck from falling back and forth, right and left.

Also, the neck pillow 1 is provided with an openable and closable zip fastener 5 that can be adjusted to open from an upper edge of the cylindrical body to a height of the lower jaw. This zip fastener 5 allows wearers to adjust degree of head retention to suit their preferences, even if the wearers have different neck lengths and/or thicknesses, different shapes of the lower jaws, and so forth. The zip fastener 5 of the neck pillow 1 in accordance with Embodiment 1 is a double-open fastener that is openable and closable from an upper edge and a lower edge of a front part 2 (lower jaw side); however, the fastener does not have to be openable and closable from the lower edge as long as the fastener is openable and closable from at least the upper edge. If the zip fastener 5 can be opened and closed from the lower edge, the wearer can adjust the neck pillow to a more desired head retention.

In FIG. 1 to FIG. 6 and FIG. 7, the front part 2 is placed on the front end of the lower jaw side and has at least a length from near a lower end of the lower jaw 7 to, for example, near a sternum upper end 8. This length allows the neck pillow 1 to fill a space formed by the lower end of the lower jaw 7, the neck, and the sternum upper end 8. This enables the support to the lower jaw to increase; and as a result, the neck can be prevented from falling forward. The length of the front part 2 can be, for example, 20 to 30 cm (in the drawings, about 15 cm). Furthermore, the front part 2 is desirably longer than a back part 4. Due to a structure of a human body, the neck tends to fall forward. If the front part 2 of the neck pillow 1 is longer than the back part 4, the neck pillow can firmly support the neck because an amount of the filling material becomes greater in the front part 2 and can prevent the neck from falling forward even when pressure is applied on the neck pillow 1 worn around the neck. It is more desirable for the front part 2 to be 1 to 15 cm longer than the back part 4 (in the drawings, about 23 cm).

Side parts 3 (i.e., a right side part 3*a* and a left side part 3*b*) are placed below near ears 9 and have a length that reaches, for example, from near the lower end of the lower jaw 7 to near a scapular upper end. This length allows the neck pillow 1 to fill a space formed by near the lower end of the lower jaw 7, the neck, and near the scapular upper end. As a result, the support to the head can be increased; and the neck can be prevented from falling to the left or right. The side parts 3 may have diagonal shapes that become longer from the back part 4 toward the front part 2.

The back part 4 is placed inferiorly from around an occipital lower end and has a length that reaches at least from around the occipital lower end to around the scapular upper end. This length allows the neck pillow 1 to fill a space formed by the occipital lower end, the neck, and around the scapular upper end. The support for the head toward the back side thus can be enhanced; and as a result, the neck can be prevented from falling backward.

The front part 2, the side parts 3, and the back part 4 may have seams 6*a* and 6*b* at least one-third (⅓) of a length from the upper edge in a longitudinal direction of a wearer's neck, the seams being placed at boundaries and in the centers of the above parts in order to hamper the filling material from leaking into the other parts reciprocally. By having the seams 6*a* and 6*b*, the movement of the filling material is prevented, and thus the neck pillow 1 is capable of preventing the neck from collapsing, even if compression is partially applied onto the neck pillow being worn. The seams also make it possible for the neck pillow 1 to better fit the outline of the neck. With the seams 6*a* and 6*b*, the upper side of the neck pillow 1 in the longitudinal direction of the neck may come to form eight bag bodies. The number of the bag bodies is not limited to eight, and may be, for example, four to sixteen.

The seams 6*a* at the boundary between the front part 2 and the left side part 3*a*, the boundary between the front part 2 and the right side part 3*b*, the boundary between the left side part 3*a* and the back part 4, and the boundary between the right side part 3*b* and the back part 4 may be formed up to the lower edge of the neck pillow 1 or may be formed to the middle. The seams formed up to the lower edge can prevent the collapse of the neck, which could be caused by the movement of the filling material.

The seams 6*b* in the center of the front part 2, the center of the left side part 3*a*, the center of the right side part 3*b*, and the center of the back part 4 may be formed up to the lower edge or may be formed to the middle. If the seams are formed up to the lower edge, it is possible to make the neck pillow 1 conform to the outline of the neck more closely. If the seams are formed to the middle, an amount of the filling material in a lower part of the neck pillow 1 becomes larger than an amount of the filling material in an upper part thereof, allowing the neck support to be further enhanced.

Figure 8:
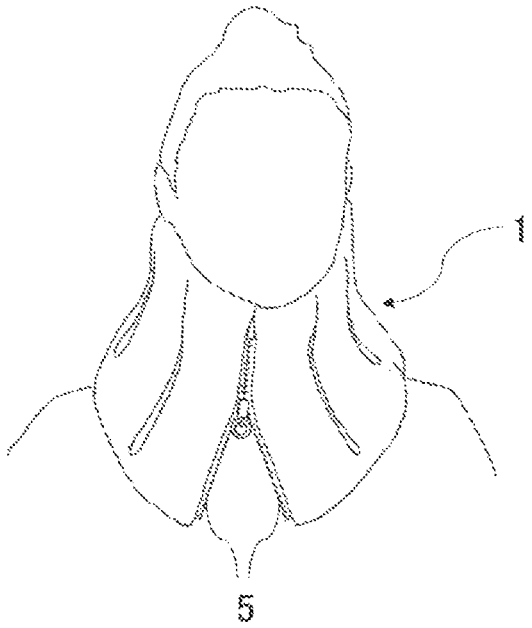
FIG. 8 shows a reference diagram of an example of how the neck pillow in accordance with Embodiment 1 is used.

FIG. 8 shows a reference diagram of another example of how the neck pillow 1 is used. In this drawing, the zip fastener 5 is pulled up about one-third (⅓) from its bottom in order to separate about one-third (⅓) of the front part 2 from the bottom into right and left. By using the zip fastener in this way, the neck pillow becomes adjustable properly to a length of a wearer's neck.

FIG. 9 shows a reference diagram of another example of how the neck pillow 1 is used. In this drawing, the zip fastener 5 is lowered about one-third (⅓) from its top in order to separate about one-third (⅓) of the front part 2 from the top into right and left; and then about one-third (⅓) of the front part from the upper edge of the neck pillow 1 is folded outward throughout an entire circumference of the neck pillow. By folding the neck pillow 1, the length of the neck pillow 1 can be properly adjusted to the length of the wearer's neck; and the folded neck pillow can better prevent the neck from falling back and forth, left and right. When used in this way, the neck pillow 1 may come to look like a blooming flower, thereby achieving an effect of increasing its aesthetic appeal.

FIGS. 10(*a*) and 10(*b*) show reference diagrams of how to adjust the neck pillow 1 to a neck retaining height and a neck circumference length of a wearer by using the zip fastener 5. FIG. 10(*a*) shows how to adjust the neck pillow 1 for a wearer with a long neck length and/or a short neck circumference length. FIG. 10(*b*) shows how to adjust the neck pillow 1 for a wearer with a short neck length and/or a long neck circumference length. As described above, one single neck pillow 1 of the present invention can be adjusted as needed to fit the neck configuration of every wearer, without having to prepare multiple products to fit the neck configurations of wearers.

FIGS. 11(*a*) to 11(*c*) show how to use the neck pillow 1. The neck pillow 1 is unfolded by lowering the zip fastener 5 from its top. Then, the center of the neck pillow 1 is placed against the back of the neck, and the neck pillow 1 is wrapped around the neck so as to make the neck pillow fit along the neck (FIG. 11(*a*)). By pulling up the zip fastener 5 from its bottom toward the top, the neck pillow 1 can be worn (FIGS. 11(*b*) and 11(*c*)).

The neck pillow 1 may be provided with, for example, a hood attached to the upper edge of the back part 4. For example, by wearing the neck pillow 1 on a night bus or the like and putting the hood on the head, the neck can be prevented from collapsing while the hood blocks out other passengers' eyes, thereby allowing a wearer to be even more comfortable.

Furthermore, the neck pillow 1 may have a cloth portion that covers, for example, from the upper edge of the front part 2 to near the nose. Since this cloth portion serves as a mask, the neck pillow 1 being worn is capable of suppressing dryness of the throat. Having the cloth portion makes the neck pillow effective when it is assumed that a user will sleep while wearing the neck pillow 1.

Embodiment 2

Figure 12:
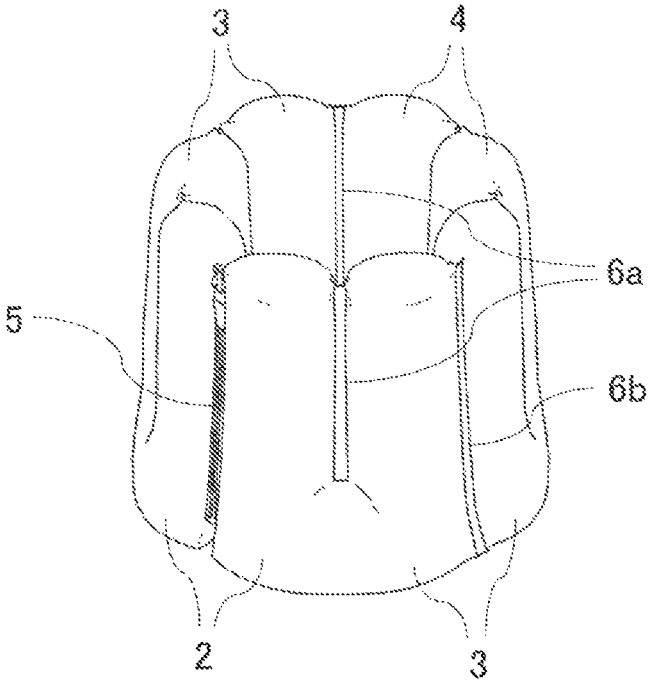
FIG. 12 shows a reference diagram of a perspective view of a neck pillow in accordance with Embodiment 2.
Figure 13:
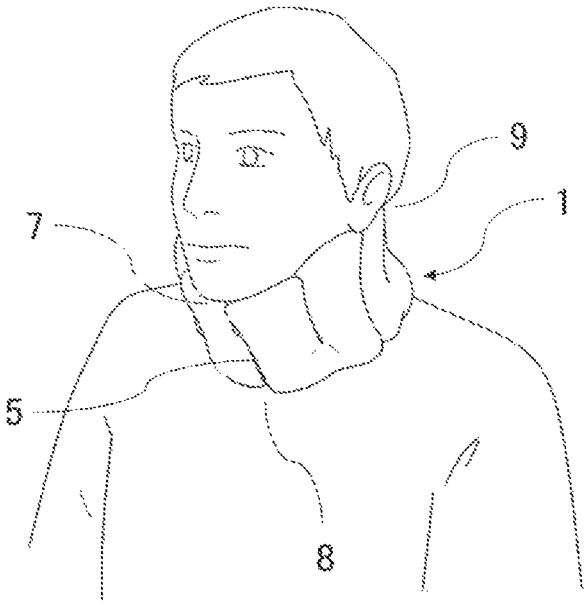
FIG. 13 shows a reference diagram of an example of how the neck pillow in accordance with Embodiment 2 is used.

FIG. 12 and FIG. 13 show another example of a neck pillow 1.

FIG. 12 shows a reference diagram of a perspective view of the neck pillow 1 in accordance with Embodiment 2.

FIG. 13 shows a reference diagram of an example of how the neck pillow 1 in accordance with Embodiment 2 is used.

The neck pillow 1 in accordance with Embodiment 2 has a cylindrical shape in which heights of the front part 2, the side parts 3, and the back part 4 in a direction of a length of the neck are almost the same. The neck pillow 1 in accordance with Embodiment 2 is also capable of sufficiently supporting the neck.

This neck pillow 1 is provided with the zip fastener 5 that can be opened only from the upper portion of the front part 2 (lower jaw side). This zip fastener 5 allows wearers to adjust degree of neck retention to suit their preferences even if the wearers have different neck lengths (long or short) or thicknesses (thick or thin), or different shapes of the lower jaws.

The front part 2, the side parts 3, and the back part 4 of this neck pillow 1 are provided with the seams 6*a* and 6*b* at least one-third (⅓) of the length from the upper edge in a longitudinal direction of a wearer's neck, the seams being placed at boundaries of the parts and in the centers of the parts in order to prevent the filling material from leaking reciprocally. The seams 6*a* and 6*b* prevent the neck from collapsing because the seams hinder the movement of the filling material even if pressure is partially applied to the neck pillow 1 when worn. The seams also allow the neck pillow 1 to follow the contours of the neck even more. The seams 6*a* at the boundaries between the front part 2 and the side parts 3 and at the boundaries between the side parts 3 and the back part 4 may be formed up to the lower edge of the neck pillow 1 or may be formed halfway. The seams formed up to the lower edge of the neck pillow are capable of preventing the neck from collapsing, which may be caused by the movement of the filling material.

The seams 6*b* in the center of the front part 2, the center of the side parts 3, and the center of the back part 4 may be formed up to the lower edge or may be formed halfway. If the seams are formed all the way to the lower edge, it is possible for the neck pillow 1 to fit the outline of the neck even more. If the seams are formed halfway, an amount of the filling material in a lower part of the neck pillow 1 becomes larger than an amount of the filling material in an upper part thereof, making the neck support further enhanced.

Preferred aspects of this invention include combinations of any of the above-described aspects.

In addition to the above-described Embodiments, there can be all sorts of variations of this invention. Those variations should not be understood as not belonging to the scope of this invention. This invention should include the meanings equivalent to the claims and all variations that fall within the scope.

REFERENCE SIGNS LIST

1: neck pillow
2: front part
3: side part
3*a*: right side part
3*b*: left side part
4: back part
5: zip fastener
6*a*: seams at boundaries between the front part and the side parts and at boundaries between the side parts and the back part
6*b*: seams in the center of the front part, the center of the side parts, and the center of the back part each
7: near a lower end of the lower jaw
8: near a sternum upper end
9: near ears

The invention claimed is:

1. A neck pillow comprising a cylindrical body that is adapted to encircle a neck of a human body, wherein the neck pillow is adapted to be worn around and detachable from the neck, wherein the cylindrical body has hardness for stably supporting the neck of the wearer and is provided with a lower jaw-engaging portion and a fastener that are on a front side of the cylindrical body, wherein the fastener is configured to be opened and closed, wherein the cylindrical body has a shape in which the front side extends downward longer than a back side of the cylindrical body, and wherein a degree of opening of the fastener is configured to be adjusted by a millimeter unit from an upper edge of the cylindrical body in accordance with a height of a lower jaw of the wearer, wherein the fastener is a is a double-open zip fastener that is configured to be opened and closed from the upper edge and a lower edge of the front side of the cylindrical body.

2. The neck pillow according to claim 1, wherein the fastener has a length of 10 to 4.

3. The neck pillow according to claim 1, wherein the fastener is openable and closable from at least one of a top and a bottom thereof.

4. The neck pillow according to claim 1, wherein the cylindrical body has a shape in which the front side of the cylindrical body extends 1 to 15 cm downward longer than the back side.

5. The neck pillow according to claim 1, wherein the cylindrical body has at least a length such that the upper edge is positioned near the lower jaw of the wearer, and a lower edge is positioned at an upper part of a sternum of the wearer, on a front side of the wearer.

6. The neck pillow according to claim 1, wherein the cylindrical body has a shape in which an inner surface surrounding the neck widens in a downward direction on the front side toward the lower side of the cylindrical body.

7. The neck pillow according to claim 6, wherein the cylindrical body has a shape in which a lower edge on the front side extends 0.1 to 10 cm further than the upper edge in a front-back direction with respect to the inner surface surrounding the neck.

8. The neck pillow according to claim 1, wherein the cylindrical body comprises four to sixteen bag bodies configured to enclose filling material therein, at least in an upper part of the cylindrical body.

* * * * *